US006775984B2

(12) United States Patent
Lavie et al.

(10) Patent No.: US 6,775,984 B2
(45) Date of Patent: Aug. 17, 2004

(54) FULL COOLING OF MAIN INJECTORS IN A TWO-HEADED COMBUSTION CHAMBER

(75) Inventors: Alain Lavie, Yerres (FR); Stéphanie Martelli, Paris (FR); Marion Michau, Vincennes (FR); José Rodrigues, Nandy (FR); Alain Tiepel, Chailly en Biere (FR)

(73) Assignee: SNECMA Moteurs, Paris (FR)

( * ) Notice: Subject to any disclaimer, the term of this patent is extended or adjusted under 35 U.S.C. 154(b) by 69 days.

(21) Appl. No.: 09/988,522

(22) Filed: Nov. 20, 2001

(65) Prior Publication Data

US 2002/0073707 A1 Jun. 20, 2002

(30) Foreign Application Priority Data

Nov. 21, 2000 (FR) ..... 00 15004

(51) Int. Cl.[7] ..... F23R 3/28; F02C 7/22

(52) U.S. Cl. ..... 60/740; 60/742; 60/746; 239/132.3; 239/406

(58) Field of Search ..... 60/746, 747, 740, 60/742, 748; 239/404, 405, 406, 132.3

(56) References Cited

U.S. PATENT DOCUMENTS 3,224,679 A * 12/1965 Kear et al. ..... 239/132.3
3,266,552 A * 8/1966 Denis ..... 239/132.3
3,285,007 A * 11/1966 Carlisle et al. ..... 60/748
3,972,690 A * 8/1976 VAN Os ..... 48/212
4,070,826 A * 1/1978 Stenger et al. ..... 60/748
4,216,908 A * 8/1980 Sakurai et al. ..... 239/406
4,644,878 A * 2/1987 Nodd et al. ..... 239/406
4,858,538 A * 8/1989 Kuypers et al. ..... 239/132.3
5,127,346 A * 7/1992 Kepplinger et al. ..... 239/132.3
5,570,580 A 11/1996 Mains ..... 60/74.2
5,577,386 A * 11/1996 Alary et al. ..... 60/742
5,642,621 A * 7/1997 Alary et al. ..... 60/747
6,351,948 B1 * 3/2002 Goeddeke ..... 60/740
6,457,316 B1 * 10/2002 Czachor et al. ..... 60/742

* cited by examiner

*Primary Examiner*—Ted Kim
(74) *Attorney, Agent, or Firm*—Oblon, Spivak, McClelland, Maier & Neustadt, P.C.

(57) ABSTRACT

An injector of a two-headed combustion chamber of a turbomachine has a first feed tube which is connected to an annular injection piece for discharging primary fuel into the combustion chamber. It also has a second feed tube surrounding the first feed tube and connected to a cylindrical endpiece for discharging secondary fuel into said combustion chamber. This endpiece has an annular channel of diameter that is greater than the diameter of the second feed tube and that extends over its entire length. A third tube is provided that surrounds the second tube and that is connected to a tubular separation element which is inserted in the annular channel of the cylindrical endpiece so as to form two annular spaces in which a cooling fluid can flow over 360° all the way to the end of the injector.

3 Claims, 2 Drawing Sheets

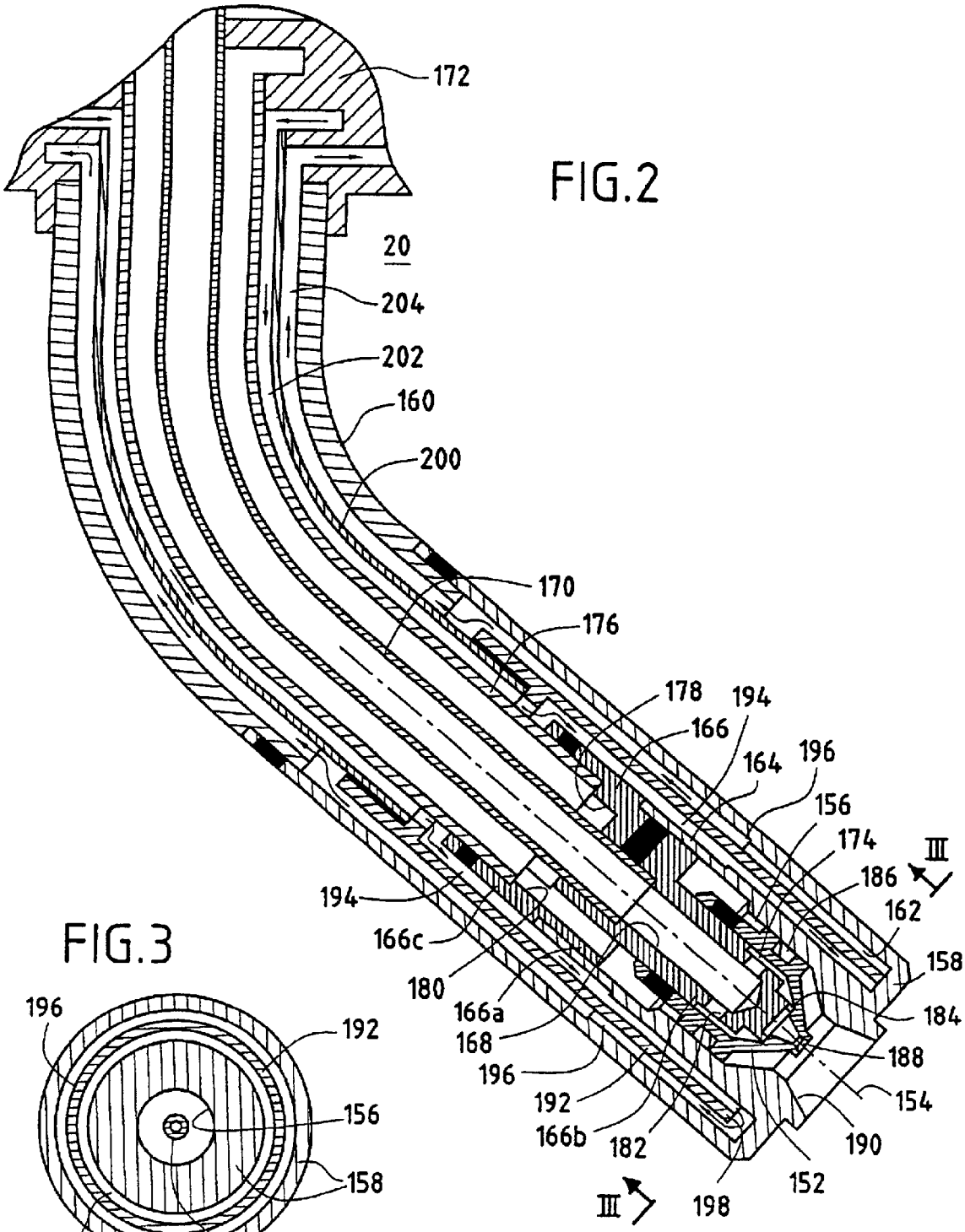
FIG.2
FIG.3
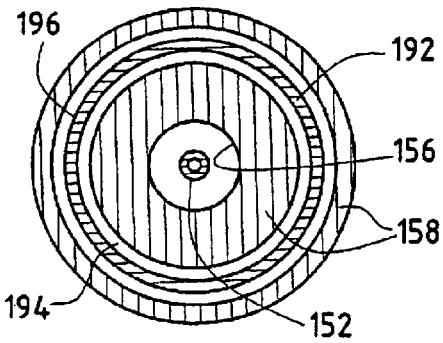

FULL COOLING OF MAIN INJECTORS IN A TWO-HEADED COMBUSTION CHAMBER

The invention relates to the general field of fuel injectors in turbomachines, and more particularly it relates to cooling main injectors in a two-headed combustion chamber of such a turbomachine.

PRIOR ART

A turbojet or a turboprop (referred to below in the present description as a "turbomachine") having a twoheaded combustion chamber is started and kept idling using so-called "pilot" injectors only, while "main" injectors are additionally brought into use while cruising. Pilot injectors are fed with fuel on a permanent basis, whereas main injectors are fed only once the turbomachine is rotating at more than some minimum determined speed (generally lying in the range 10% to 30% of its nominal speed). Furthermore, during so-called "stage burning", only half of the main injectors are in operation, with the other half of the main injectors then being temporarily stopped.

Unfortunately, while idling, and even more during stage burning, it is necessary to cool the main injectors, and most particularly to cool their ends that extend into the combustion chamber (often referred to as "tips") in order to avoid coking problems.

Various injector architectures have been proposed to resolve this problem. Thus, in its French patent application No. FR 2 721 694, the Applicant has disclosed a main injector which is locally cooled by the fuel feeding a pilot injector, which fuel is conveyed via a central duct to the end of the injector and is returned via a coaxial annular duct. American patent No. U.S. Pat. No. 6,003,781 discloses a main injector provided with an independent cooling circuit, the cooling fluid being taken to the end of the injector via a top inlet channel and being returned via a bottom return channel.

Nevertheless, those prior art systems suffer from the same major drawback, that of cooling the end portion of the injector in localized manner only, thereby leaving entire areas that are not cooled. As a result, under certain operating conditions, particularly at high temperatures, e.g. around 900° C., the end portion of the injector is not cooled sufficiently so it is not possible to avoid coke forming.

OBJECTS AND DEFINITION OF THE INVENTION

The present invention seeks to provide a cooling circuit that makes it possible in main injectors to avoid such formation of coke at high temperature. An object of the invention is thus to provide complete protection for the fuel circuits of such injectors. Another object of the invention is to provide such a circuit in a manner that is simple and without significantly altering the size of the injectors. Yet another object of the invention is to provide a cooling circuit that prevents maximum effectiveness in terms of extracting the from the fuel.

These objects are achieved by a system for cooling an injector of a combustion chamber of a turbomachine, said injector comprising means for delivering a primary fuel comprising a first feed tube connected to an annular injection piece having first injection orifices for discharging the primary fuel into said combustion chamber; and means for delivering a secondary fuel comprising a second feed tube surrounding said first feed tube and connected to a cylindrical endpiece surrounding said annular injection piece and having second injection orifices for discharging the secondary fuel into said combustion chamber, said endpiece further comprising an annular channel of diameter greater than that of said second feed tube and extending over its entire length beyond said first injection orifices; the system comprising means for delivering a cooling fluid comprising a third tube surrounding said second tube and having a tubular separation element connected thereto which is introduced in said annular channel of said cylindrical endpiece so as to form two annular spaces in which the cooling fluid can flow over 360° all the way to the end of the injector.

With this particular structure, cooling is provided uniformly all the way to the far end of the tip of the main injector, where the temperature is the highest, and above all cooling is performed completely (i.e. over 360°) and not merely locally as in prior art systems.

Advantageously, the first and second feed tubes and the third tube are coaxial and the annular injection piece is connected to said first feed tube through a cylindrical connection piece.

The present invention also provides a fuel injector for a turbomachine combustion chamber, the injector including a cooling system as defined above.

BRIEF DESCRIPTION OF THE DRAWINGS

The characteristics and advantages of the present invention appear more clearly in the following description, given by way of non-limiting indication and with reference to the accompanying drawings, in which:

FIG. 2 is a detailed view on a greatly enlarged scale of a main injector in accordance with the present invention; and FIG. 3 is a cross-section on plane III—III through the end of the FIG. 2 injector tip.

DETAILED DESCRIPTION OF A PREFERRED EMBODIMENT

Figure 1:
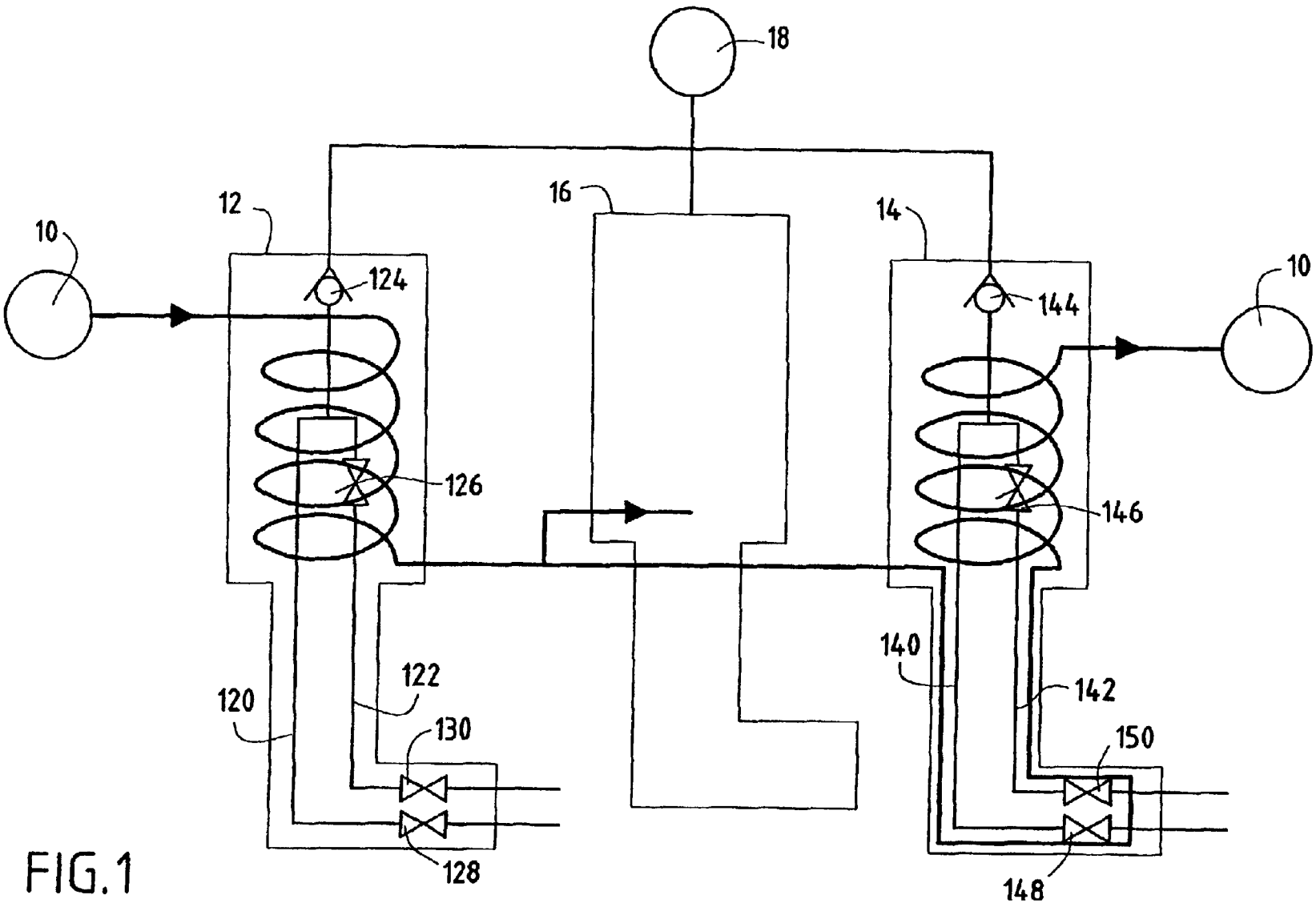
FIG. 1 is a schematic showing the cooling circuit for fuel injectors in a turbomachine.

FIG. 1 is a schematic of the cooling circuit for fuel injectors in a two-headed annular combustion chamber of a turbomachine.

The cooling circuit is shown only for two injectors so as to make it easier to understand (such a combustion chamber can have as many as 16 pilot injectors and 32 main injectors, for example), and it is fed from a feed source 10 by an independent cooling fluid such as oil, water, fuel, or any other suitable fluid which passes successively through a "pilot" injector 12 for starting the turbomachine and enabling it to be idle (i.e. operate at low power), and is then fed in parallel to two "main" injectors 14, 16 (organized on the basis of one even rank and one odd rank), which injectors enable the machine to operate during cruising stages (and in particular at full power). The cooling fluid then returns to the feed source 10, thereby closing the cooling circuit (naturally and in conventional manner this circuit also includes a cooling fluid feed pump, filters, and various hydraulic members for controlling the flow rate of the fluid).

The structure of the pilot and main injectors is of aeroengine type and is identical concerning the fuel circuits and the control thereof, each injector having two fuel circuits comprising a primary circuit 120, 140 for low flow rates, and a secondary circuit 122, 142 for high flow rates. A check valve 124, 144 cuts off a stopped injector from a fuel feed source 18, and a metering valve 126, 146 controls the secondary circuit so as to guarantee good performance when switching over between the primary and secondary circuits. Each circuit is also provided at its end portion with a swirler 128, 130; 148, 150 of a shape for ensuring that the fuel is atomized (set into rotation).

In the pilot injectors 12, the cooling circuit does no more than surround the head-end of the metering valve 126, whereas in the main injectors 14, 16, the cooling circuit extends to the far end or tip of such an injector prior to returning towards the metering valve 146 which it also surrounds. It is known that the problem of coke formation is present essentially at the main injectors since, during certain stages of operation, they can be subjected to extremely high temperatures while they have no fuel flowing through them, whereas the temperature at the ends of the pilot injectors does not exceed the coking limit (150° C.) because they have fuel flowing through them during all stages of operation. Under such circumstances, there is no need to provide pilot injectors with cooling at their ends.

FIG. 2 is a detail view showing the tip portion of a main injector 12, 14 of the invention that is extends into a combustion chamber 20. This figure is deliberately enlarged so as to show up significant details. It should be observed that a real injector has an end portion whose diameter is only about 10 millimeters (mm) to about 15 mm.

In this end portion, the injector comprises an annular injection piece 152 having a longitudinal axis 154 (corresponding to the central axis of the injector), mounted in an internal bore 156 of a cylindrical endpiece 158 which is itself fixed by brazing to the end of the outer wall 160 of the injector. This endpiece has an annular channel 162 which surrounds the internal bore 156 and of a depth which extends beyond the end of the annular injection piece 152, and it is separated therefrom by a cylindrical sleeve 164 whose upstream end is fixed on a cylindrical central portion 166*a* of a connection piece 166 by brazing. In this central portion, and extending into a downstream portion 166*b*, the cylindrical piece 166 has a blind axial bore 168 whose free end is brazed to the end of a first feed tube 170 for bringing primary fuel from the injector body 172 to which the tube is connected upstream (said body being itself fixed in conventional manner to the casing of the turbomachine which is not shown). The downstream portion 166*b* of this cylindrical piece 166 having a diameter that is smaller than the central portion is engaged in part in an inner bore 174 of the annular injection piece 152 and is fixed thereto by brazing, while its upstream portion 166*c* which presents a diameter (corresponding to the thickness of the sleeve 164) greater than the diameter of the central portion is fixed to the end of a second feed tube 176 by brazing, which second feed tube is coaxial to the preceding tube and of greater diameter, for the purpose of bringing secondary fuel from the injector body 172 to which said second tube is also connected upstream. This second tube opens out into an annular internal cavity 178 formed in the upstream portion 166*c* and pierced by at least one longitudinal orifice 180 to allow secondary fuel to flow through the piece 166.

The connection piece 166 is also pierced at its blind end by at least one transverse orifice 182 for putting its axial bore 168 into communication with the inner bore 174 of the annular injection piece 152. Similarly, its free downstream end is pierced by tangential channels (forming the primary swirler 184) for setting the primary fuel that comes from the first feed tube 170 into rotation, which fuel passes in succession via the axial bore 168, the inner bore 174, and the transverse orifices 182. Similarly, the annular injection piece 152 is provided on its outer wall in contact with the internal bore 156 of the cylindrical endpiece 158 with helical or tangential grooves (forming the secondary swirler 186) for setting the secondary fuel that comes from the second feed tube 176 into rotation, which fuel passes in succession via the annular cavity 178, the transverse orifices 180, and the internal bore 156. At its free end which is not connected to the connection piece 166, said annular injection piece 152 has a first injection orifice 188 provided with a primary discharge cone for the primary fuel leaving the tangential channels 184. Similarly, for the secondary fuel leaving the helical grooves 186, provision is made for the internal bore 156 of the cylindrical endpiece 158 surrounding the annular piece 152 to be terminated by a second injection orifice 190 carrying a secondary discharge cone concentric with the preceding discharge cone.

In addition to the means for delivering primary and secondary fuel as described above, the injector also comprises means for delivering a specific cooling fluid that enables the entire injector to be cooled with maximum extraction of heat. For this purpose, a tubular separation element 192 is inserted in the annular channel 162 of the endpiece 158 so as to define on either side of said element first and second coaxial annular spaces 194 and 196 in which a cooling fluid can flow under pressure. The cooling fluid passes between these two annular spaces via through orifices 198 formed in said separation element at its downstream end which rests against the bottom of the channel 162 and which extends beyond the first injection orifice 188, thereby guaranteeing cooling all the way to the end of the injector. The upstream end of this separation element is fixed by brazing to a third tube 200 that is coaxial with the first and second feed tubes 170 and 176, but which is slightly greater in diameter, and like said feed tubes it is connected at its own upstream end to the injector body 172. The tube 200 thus defines a first annular duct 202 around the second feed tube 176 for delivering cooling fluid, and a second annular duct 204 between said tube 200 and the outer wall of the injector 160 to return the cooling fluid to the fluid source 10 after it has followed a go-and-return path over the entire length of the injector via the annular spaces 194, 196. This go-and-return configuration over the entire length of the primary and secondary fuel feed ducts by means of a cooling duct which completely surrounds the feed ducts, makes it possible to extract a maximum amount of heat, unlike prior art devices which usually comprise a go duct on one side of the injector and a return duct on the other side.

Thus, with this particular structure, the cooling circuit is fully integrated in the injector which therefore benefits from extreme miniaturization. The full cooling performed over 360° makes it possible to guarantee that the injector will operate under all circumstances, i.e. even under the most severe of operating conditions, particularly at a very high temperature. This high degree of effectiveness of the cooling circuit of the invention has been verified in tests which have shown a considerable improvement.

What is claimed is:

1. A cooling system for a main injector of a two-headed combustion chamber of a turbomachine, said main injector comprising an annular piece provided with a first injection orifice for discharging a primary fuel into said combustion chamber, said primary injection orifice being fed upstream from a first feed tube and having an endpiece surrounding said annular piece and provided with a second injection orifice for discharging a secondary fuel into said combustion chamber, said second injection orifice being fed upstream from a second feed tube, wherein said endpiece includes an annular channel of depth that extends beyond said first injection orifice, said annular channel having a tubular separation element therein to define first and second coaxial annular spaces on either side of said element for cooling fluid flow, cooling fluid passing between said two annular spaces via through orifices formed in said separation element at a downstream end of said element resting on the bottom of the channel, wherein said tubular separation element is fixed upstream to a third tube surrounding said first and second feed tubes and co-operating firstly with said second feed tube to define a first annular duct which brings the cooling fluid from a fluid source via said first annular space to said endpiece, and secondly with an outer wall of the injector to define a second annular duct which returns the cooling fluid to said fluid source via said second annular space, and wherein said tubular separation element is brazed to said third tube which is connected upstream to the injector body.

2. A cooling system according to claim 1, wherein said first and second feed tubes and said third tube are coaxial.

3. A main injector for a two-headed combustion chamber of a turbomachine including a cooling system according to claim 1.

* * * * *